US009504110B2

(12) United States Patent
Kim et al.

(10) Patent No.: US 9,504,110 B2
(45) Date of Patent: Nov. 22, 2016

(54) AC LIGHTING SYSTEM WITH A CONTROL UNIT FOR CONTROLLING POWER OF AN LED

(71) Applicants: Minjong Kim, San Jose, CA (US); Weifeng Chen, San Jose, CA (US); Jungung Kim, San Jose, CA (US); Jae Hong Jeong, Saratoga, CA (US); Kyeongtae Moon, San Ramon, CA (US)

(72) Inventors: Minjong Kim, San Jose, CA (US); Weifeng Chen, San Jose, CA (US); Jungung Kim, San Jose, CA (US); Jae Hong Jeong, Saratoga, CA (US); Kyeongtae Moon, San Ramon, CA (US)

(73) Assignee: Altoran Chips & Systems, Santa Clara, CA (US)

( * ) Notice: Subject to any disclaimer, the term of this patent is extended or adjusted under 35 U.S.C. 154(b) by 17 days.

(21) Appl. No.: 14/222,543

(22) Filed: Mar. 21, 2014

(65) Prior Publication Data

US 2015/0271884 A1 Sep. 24, 2015

Related U.S. Application Data

(60) Provisional application No. 61/804,618, filed on Mar. 22, 2013.

(51) Int. Cl.
*H05B 37/02* (2006.01)
*H05B 33/08* (2006.01)

(52) U.S. Cl.
CPC ..... *H05B 33/0845* (2013.01); *H05B 33/083* (2013.01); *H05B 33/0824* (2013.01); *H05B 37/02* (2013.01)

(58) Field of Classification Search
CPC ..... H05B 33/0809; H05B 33/0824; H05B 33/0842; H05B 37/02
USPC ..... 315/185 R, 192, 193, 209 R, 224, 291, 315/294, 306, 307
See application file for complete search history.

(56) References Cited

U.S. PATENT DOCUMENTS

| | | | | |
|---|---|---|---|---|
| 7,081,722 | B1 * | 7/2006 | Huynh | H05B 33/0818 315/185 S |
| 8,476,836 | B2 * | 7/2013 | van de Ven et al. | 315/193 |
| 2008/0001547 | A1 * | 1/2008 | Negru | H02J 7/0065 315/189 |
| 2011/0084619 | A1 * | 4/2011 | Gray et al. | 315/185 R |
| 2012/0262075 | A1 * | 10/2012 | Lynch et al. | 315/192 |
| 2013/0099683 | A1 * | 4/2013 | Sakuragi | H05B 33/083 315/185 R |
| 2014/0117854 | A1 * | 5/2014 | Liu et al. | 315/122 |
| 2015/0061528 | A1 * | 3/2015 | Raval | H05B 33/0815 315/210 |
| 2015/0296582 | A1 * | 10/2015 | Jung | H05B 33/0812 315/185 R |

* cited by examiner

*Primary Examiner* — Tung X Le

(57) ABSTRACT

An AC light system with a control unit for controlling power of an LED is disclosed. According to one embodiment, a driver circuit for driving LEDs has a plurality of current sinks, a first interface configured to receive an AC power from an AC power source, a second interface to a plurality LED groups. The driver circuit further has a third interface configured to receive a control input from a control unit. Each current sink of the plurality of current sinks controls an LED current flowing through a corresponding LED group based on the control input from the control unit.

20 Claims, 10 Drawing Sheets

AC LIGHTING SYSTEM WITH A CONTROL UNIT FOR CONTROLLING POWER OF AN LED

CROSS REFERENCES

This application claims the benefits of and priority to U.S. Provisional Application No. 61/804,618, filed on Mar. 22, 2013, entitled "AC lighting system with microcontroller unit for controlling power," the disclosure of which is hereby incorporated by reference in its entirety.

FIELD

The present disclosure relates in general to the field of computers, and in particular, to a AC lighting system with a control unit for controlling the power of the AC lighting system and a method thereof.

BACKGROUND

An alternating current (AC) lighting system refers to a system for directly driving a lighting load such as light emitting diode (LED), organic light emitting diode (OLED), or other light emitting devices or components using rectified AC line voltage from a AC power source. AC lighting systems eliminate the need of a power conversion unit from an AC power source to a direct current (DC) power source. Due to their simple design and less components, AC lighting systems provide a low-cost solution for residential or commercial applications with an AC power source. Despite their cost advantages, AC lighting systems do not provide intelligent lighting control features such as a dimming control, mood lights, color variations, etc. A control unit such as a microcontroller unit (MCU), a microprocessor, a programmable logic controller (PLC), and an application-specific integrated circuit is a suitable component for providing a power control capability to an AC lighting system.

SUMMARY

An AC light system with a control unit for controlling power of an LED is disclosed. According to one embodiment, a driver circuit for driving LEDs has a plurality of current sinks, a first interface configured to receive an AC power from an AC power source, a second interface to a plurality LED groups. The driver circuit further has a third interface configured to receive a control input from a control unit. Each current sink of the plurality of current sinks controls an LED current flowing through a corresponding LED group based on the control input from the control unit.

According to another embodiment, an AC lighting system for driving LEDs includes an AC power source, a plurality of LED groups, and an LED driver connected between the AC power source and the plurality of LED groups. The LED driver is configured to control an LED current of the plurality of LED groups. The AC lighting system further includes a control unit for providing a control input to the LED driver. The LED driver controls the LED current of the plurality of LED groups based on the control input from the control unit.

According to yet another embodiment, a method for driving a plurality of LED groups comprises providing an LED driver that is configured to control an LED current flowing through a corresponding LED group of the plurality of LED groups, receiving a control input from a control unit, and controlling the LED current based on the control input.

The above and other preferred features, including various novel details of implementation and combination of events, will now be more particularly described with reference to the accompanying figures and pointed out in the claims. It will be understood that the particular systems and methods described herein are shown by way of illustration only and not as limitations. As will be understood by those skilled in the art, the principles and features described herein may be employed in various and numerous embodiments without departing from the scope of the present disclosure.

BRIEF DESCRIPTION OF THE DRAWINGS

The accompanying drawings, which are included as part of the present specification, illustrate the presently preferred embodiment and together with the general description given above and the detailed description of the preferred embodiment given below serve to explain and teach the principles described herein.

Figure 1:
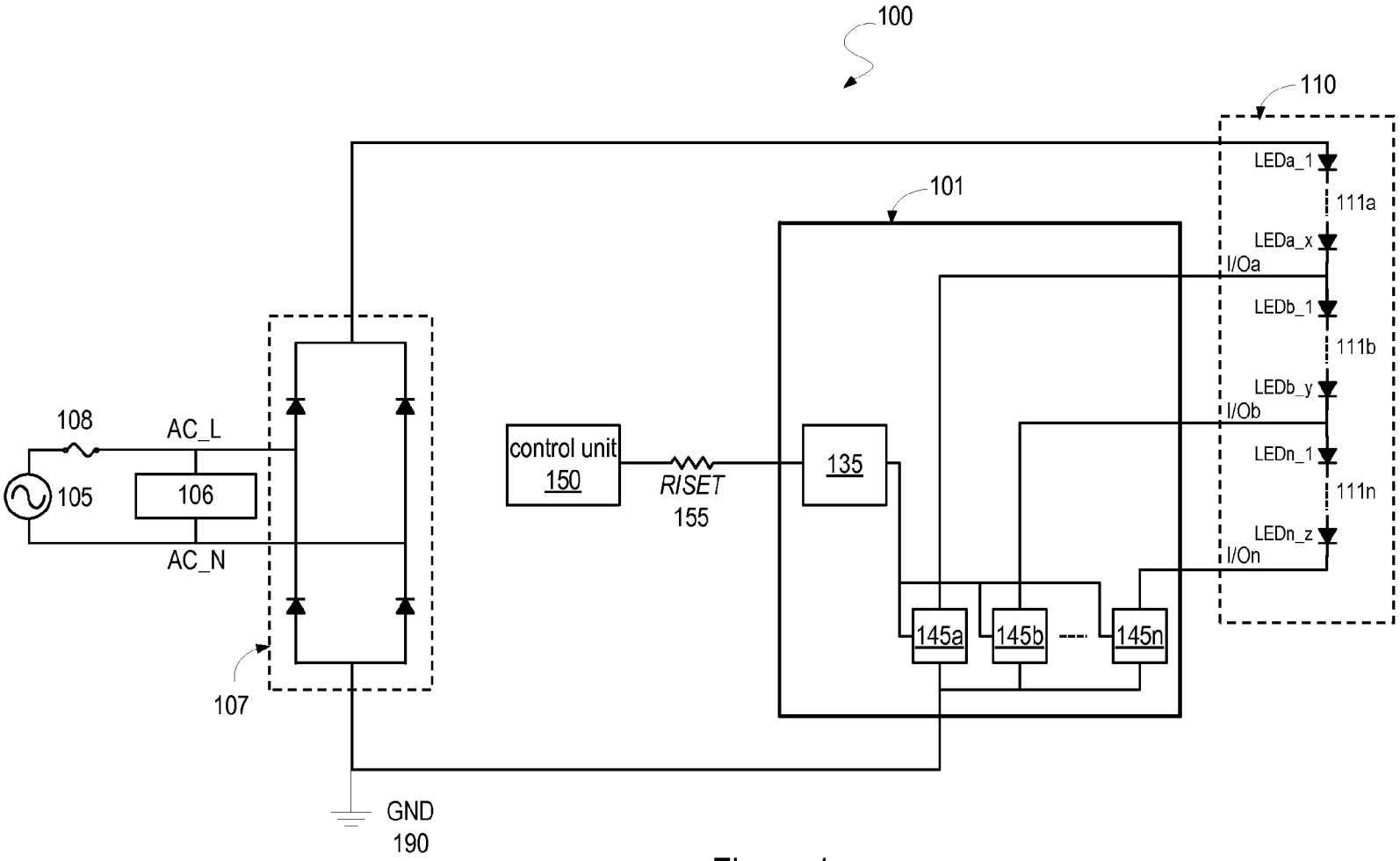
FIG. 1 illustrates a block diagram of an exemplary AC lighting system with a control unit, according to one embodiment.

The figures are not necessarily drawn to scale and elements of similar structures or functions are generally represented by like reference numerals for illustrative purposes throughout the figures. The figures are only intended to facilitate the description of the various embodiments described herein. The figures do not describe every aspect of the teachings disclosed herein and do not limit the scope of the claims.

DETAILED DESCRIPTION

An AC light system with a control unit for controlling power of an LED is disclosed. Each of the features and teachings disclosed herein can be utilized separately or in conjunction with other features and teachings to provide a method for providing an AC light system with a control unit for controlling power of an LED. Representative examples utilizing many of these additional features and teachings, both separately and in combination, are described in further detail with reference to the attached drawings. This detailed description is merely intended to teach a person of skill in the art further details for practicing preferred aspects of the present teachings and is not intended to limit the scope of the claims. Therefore, combinations of features disclosed in the following detailed description may not be necessary to practice the teachings in the broadest sense, and are instead taught merely to describe particularly representative examples of the present teachings.

In the following description, for purposes of explanation only, specific nomenclature is set forth to provide a thorough understanding of the present invention. However, it will be apparent to one skilled in the art that these specific details are not required to practice the present invention.

Some portions of the detailed descriptions that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "computing," "calculating," "determining," "displaying," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. It will be appreciated that a variety of programming languages may be used to implement the teachings of the invention as described herein.

Moreover, the various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help to understand how the present teachings are practiced, but not intended to limit the dimensions and the shapes shown in the examples.

The present disclosure relates to an AC lighting system having a microcontroller unit (MCU). It is apparent without deviating from the scope of the present disclosure that the MCU can be replaced with a microprocessor, a programmable logic controller (PLC), an application-specific integrated circuit, or any other control units providing an input to the present AC lighting system for controlling power. The AC lighting system refers to a system driving a lighting load such as LED, OLED, and other light emitting devices using rectified AC line voltage directly. The AC lighting system thus eliminates the needs of power conversion from AC to DC. According to various embodiment of the present AC lighting system, the control unit is used to aid the control of the AC lighting system either directly or indirectly.

The control unit can control lighting power using various ways. In one embodiment, the control unit adjusts current flowing through a resistor that is used to set the LED current. In another embodiment, the control unit applies reference voltage that is directly controlling the LED current. An input to the control unit can be from a) mechanical/electrical switch controlled by user b) a sensor, such as motion sensor, light sensor, touch sensor, temperature sensor and c) scaled-down rectified AC signal and so on.

An output from the control unit can either be analog signal or digital signal. The output from the control unit can be applied directly to a dedicated pin of the AC LED driver IC or applied to one side of a resistor that controls current flowing through the resistor thereby indirectly controlling the LED current.

Various applications of the present AC lighting system can be made. For example, such applications include, but are not limited to a dimming control from a 0-10V dimmer, a pulse-width-modulation (PWM) dimmer, a triode for alternating current (TRIAC) dimmer, a lighting control with various types of sensors such as a light sensor, a motion sensor, a touch sensor, a temperature sensor, a humidity sensor, etc. In another embodiment, the present AC lighting system can be used to provide protection from over-current, over-voltage, over-temperature, line fluctuation or the like.

FIG. 1 illustrates a block diagram of an exemplary AC lighting system with a control unit, according to one embodiment. The AC lighting system 100 includes an LED driver 101, a control unit 150, a setting resistor 155, and LED loads 110. The LED driver 100 is powered by a power source 105 such as an alternative current (AC) power source including a fuse 108 a transient protection circuit 106 between a live wire (AC_L) and a neutral wire (AC_N). The electrical current from the AC power source 105 is rectified by a rectifier circuit 107. The rectifier circuit 107 can be any suitable rectifier circuit, such as bridge diode rectifier, capable of rectifying the alternating power from the AC power source 105. The rectified voltage $V_{rect}$ is applied to a string of LEDs 110. If desirable, the AC power source 105 and the rectifier circuit 107 may be replaced by a direct current (DC) power source.

The LEDs as used herein is the general term for many different kinds of LEDs, such as traditional LED, super-bright LED, high brightness LED, organic LED, etc. The drivers of the present invention are applicable to all kinds of LED. A string of LEDs 110 is electrically connected to the power source 105 and divided into n groups, 111*a*-111*n*. However, it should be apparent to those of ordinary skill in the art that the string of LEDs may be divided into any suitable number of groups without deviating from the scope of the present subject matter. The LEDs in each group 111 may be a combination of the same or different kind, such as different color. The LEDs 110 can be connected in serial or parallel or a mixture of both. Also, one or more resistances may be included inside each group, say 111*a*, 111*b*, and 111*n*.

The LED driver 101 controls the LED current using a setting resistor 155 (also referred to as RISET). The LED current level setting block 135 of the LED driver 101 generates a fixed voltage, $V_{ref}$. At one end, the setting resistor 155 is connected to a pin that outputs the fixed voltage $V_{ref}$ (e.g., 1V DC) from the LED driver 101. At the other end, the setting resistor 155 is connected the ground. In this case, the current, $I_{ref}$ that flows through the setting resistor 155 is calculated by:

$$I_{ref}=V_{ref}/RISET.$$

According to one embodiment, the LED driver 101 is a direct AC step driver ACS0804 or ACS0904 by Altoran Chips and Systems of Santa Clara, Calif. The LED driver 101 integrates a plurality of high voltage current sinks 145*a*-145*n*. When the rectified voltage, $V_{rect}$, reaches the reference voltage $V_f$ of each LED group 111, each LED group 111 turns on gradually when the corresponding current sink 145 has a headroom. Each LED channel current sink increases up to a predefined current level for each current sink 145 and maintains its level until the following group's current sink reaches to its headroom. At any point in a time domain, there is at least one active LED group 111. When the active LED group is changed from one group to the adjacent group with a change in the rectified voltage, $V_{rect}$, new active group's current gradually increases while the existing active group's current gradually decreases. The mutual compensation between LED groups 111 achieves a smooth LED current change preventing blinking or flickering.

In another embodiment, the setting resistor 155 is connected to a pin out of the control unit 150 that has controlling voltage, $V_{CNTRL}$. In this case, the current, $I_{ref}$ that flows through the setting resistor 155 is calculated by:

$$I_{ref}=(V_{ref}-V_{CNTRL})/RISET.$$

The control unit 150 can change and control the controlling voltage $V_{CNTRL}$. By controlling the controlling voltage $V_{CNTRL}$, the current, $I_{ref}$ that flows through the setting resistor 155 can be carefully controlled, resulting in the control of the LED current.

According to one embodiment, the output of the control unit 150 is a pulse-width modulation (PWM) output. A PWM output contains alternating low and high signals. At a low state, the output is 0V and at a high state, the output is higher than $V_{ref}$. In this case, the duty cycle of the PWM output is translated to a duty cycle of $I_{ref}$ that in turn controls the LED current with a corresponding duty cycle. The duty cycle of the PWM output therefore changes the LED current, thus the light intensity of the LEDs 110. For example, the PWM output of the control unit 150 gradually changes the duty cycle over a predetermined period of time to provide a gradual change of the light intensity of the LEDs 110, for example, when turning on or off a switch of the AC lighting system 100.

According to another embodiment, the control unit output is a digital-to-analog converter (DAC) output. A DAC output is an analog voltage level signal that is directly used as $V_{CNTRL}$ to control $I_{ref}$.

Figure 2:
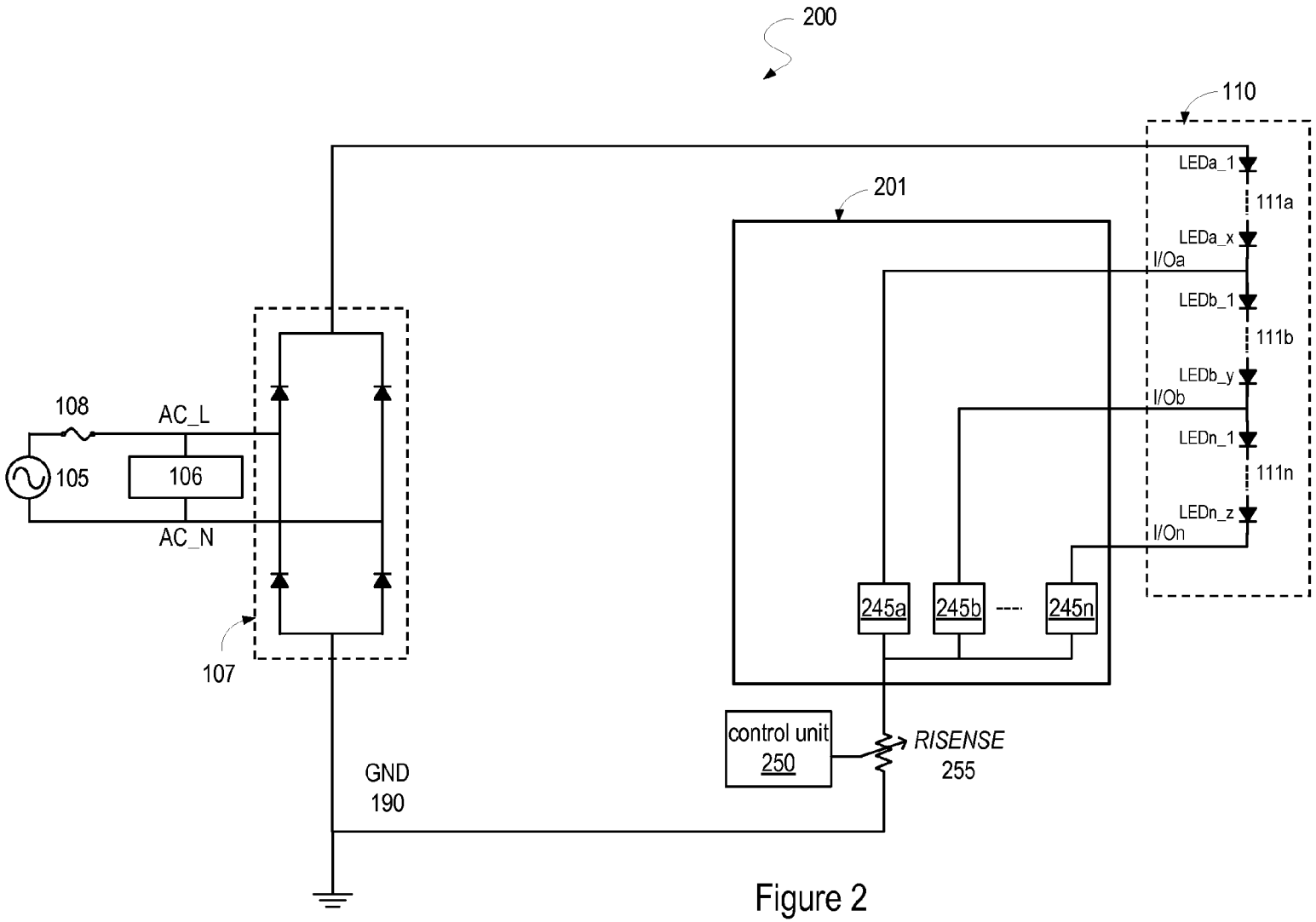
FIG. 2 illustrates a block diagram of another exemplary AC lighting system with a control unit, according to one embodiment.

FIG. 2 illustrates a block diagram of another exemplary AC lighting system with a control unit, according to one embodiment. The AC lighting system 200 includes an LED driver 201, a control unit 250, a variable sensing resistor 255, and LED loads 110. According to one embodiment, the LED driver 201 is a direct AC step driver ACS1004 or ACS1404 by Altoran Chips and Systems of Santa Clara, Calif. The LED driver 201 integrates a plurality of high voltage current sink blocks 245*a*-245*n*. The LED current is controlled by the variable sensing resistor 255 (RISENSE). Each current sink 245 is capable of controlling the voltage on the pin that is connected to the sensing resistor 255 by providing an LED current path of the corresponding LED group (111*a*, 111*b*, . . . , 111*n*) with a different voltage level, thereby capable of controlling the current level $I_{ref}$ that flows through the variable resistor 255. The control unit 250 can change and control the variable sensing resistor 255, thereby controlling the LED current and light intensity of the LEDs 110.

Figure 3:
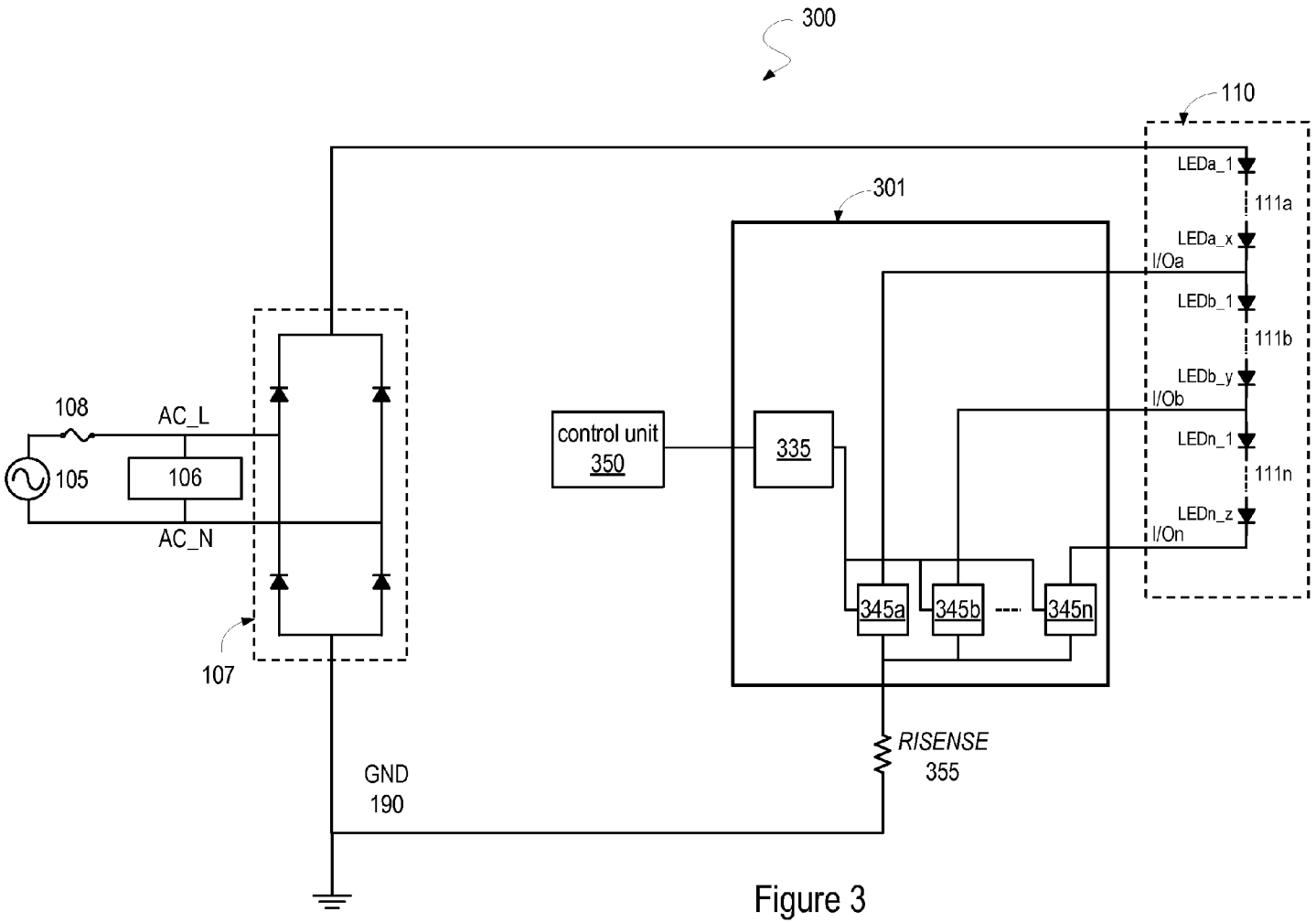
FIG. 3 illustrates a block diagram of yet another exemplary AC lighting system with a control unit, according to one embodiment.

FIG. 3 illustrates a block diagram of yet another exemplary AC lighting system with a control unit, according to one embodiment. According to one embodiment, the LED driver 301 is a direct AC step driver ACS1404 by Altoran Chips and Systems of Santa Clara, Calif. The LED current is controlled by a sensing resistor 355. Each current sink block 345*a*-345*n* controls the voltage applied to the sensing resistor 355. The applied voltage is scaled according to voltage PWM (VPWM) signals applied to a PWM pin of the LED driver 301. The PWM pin can be either digital Low/Hi signal or an analog level. The control unit 350 controls the input to the PWM pin of the LED driver 301 to control LED current.

Figure 4:
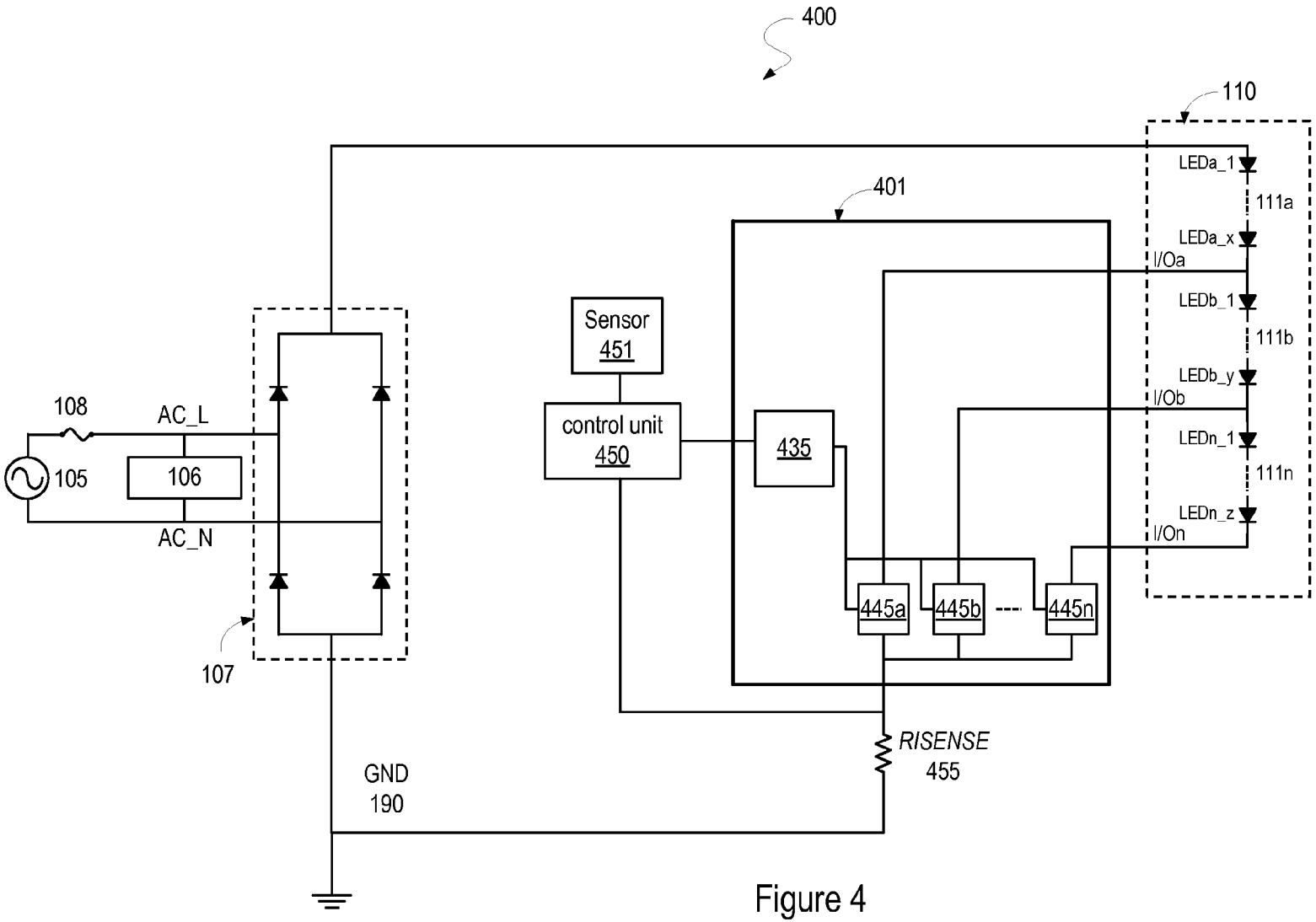
FIG. 4 illustrates a block diagram of an exemplary AC lighting system with a control unit and a sensor, according to one embodiment.

FIG. 4 illustrates a block diagram of an exemplary AC lighting system with a control unit and a sensor, according to one embodiment. The control unit 450 changes its PWM output (i.e., input to the PWM pin of the LED driver 401) based on inputs received from a sensor 405 and a sensing resistor 455. According to one embodiment, the sensor 451 is an ambient light sensor, a motion detection sensor, a temperature sensor, a line voltage fluctuation sensor. The current sensing resistor 455 has the LED current information $I_{LED}$ translated to the voltage information, $V_{LED}$. $V_{LED}$ changes as the line voltage changes. When the line voltage increases, $V_{LED}$ also increases. The control unit 450 detects the change of $V_{LED}$ and controls its PWM duty cycle and amplitude via its PWM pin to control the LED current level as desired.

Figure 5:
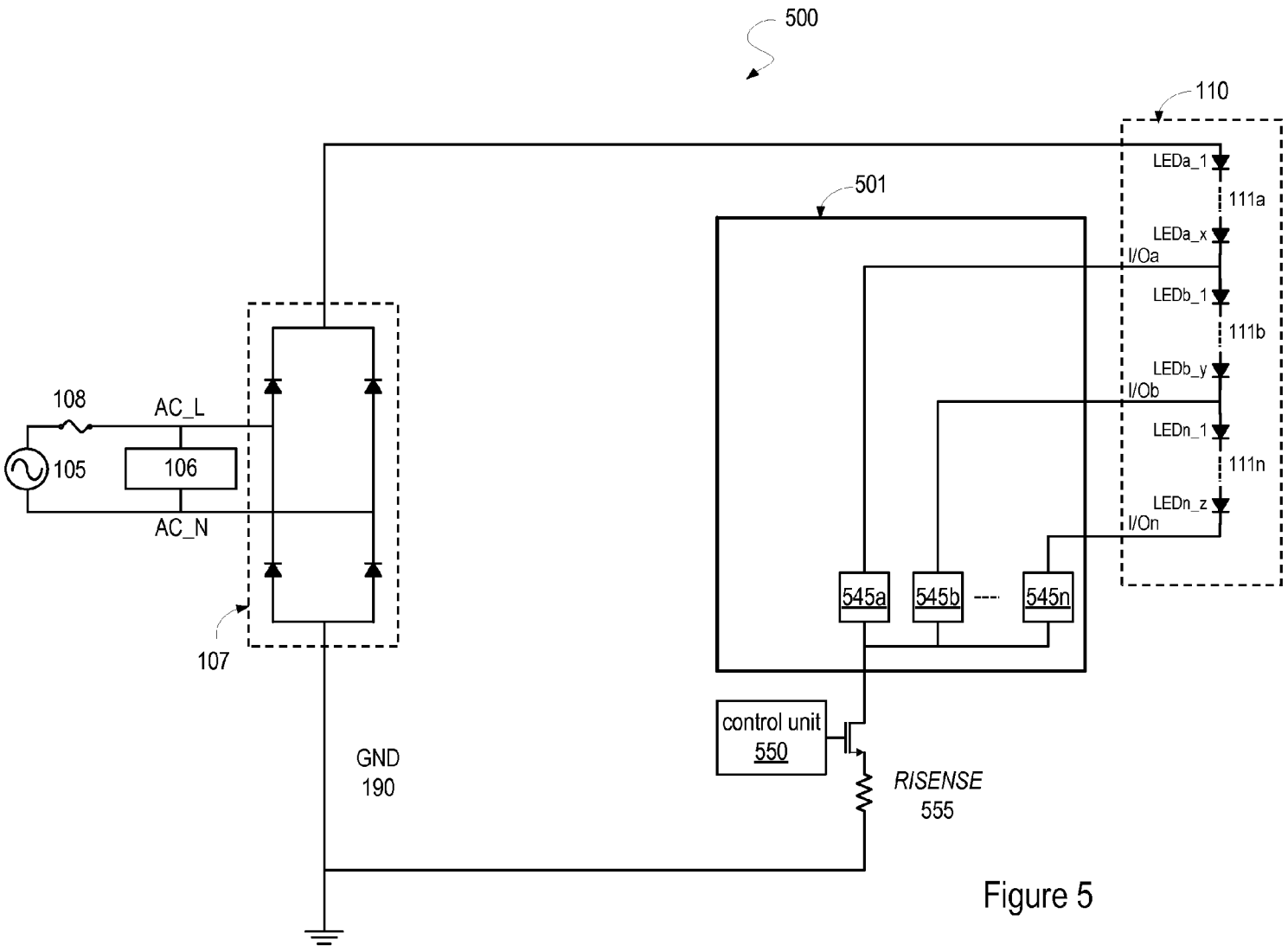
FIG. 5 illustrates a block diagram of an exemplary AC lighting system with a single LED current path controlled by a control unit, according to one embodiment.

FIG. 5 illustrates a block diagram of an exemplary AC lighting system with a single LED current path controlled by a control unit, according to one embodiment. The control unit 550 directly controls the LED current by turning on and off the current sensing resistor 555. The control unit 550 may work with a LED driver 501 that does not have a current level setting block because it can directly turn on and off the LED current at the downstream of the AC lighting system 500.

Figure 6:
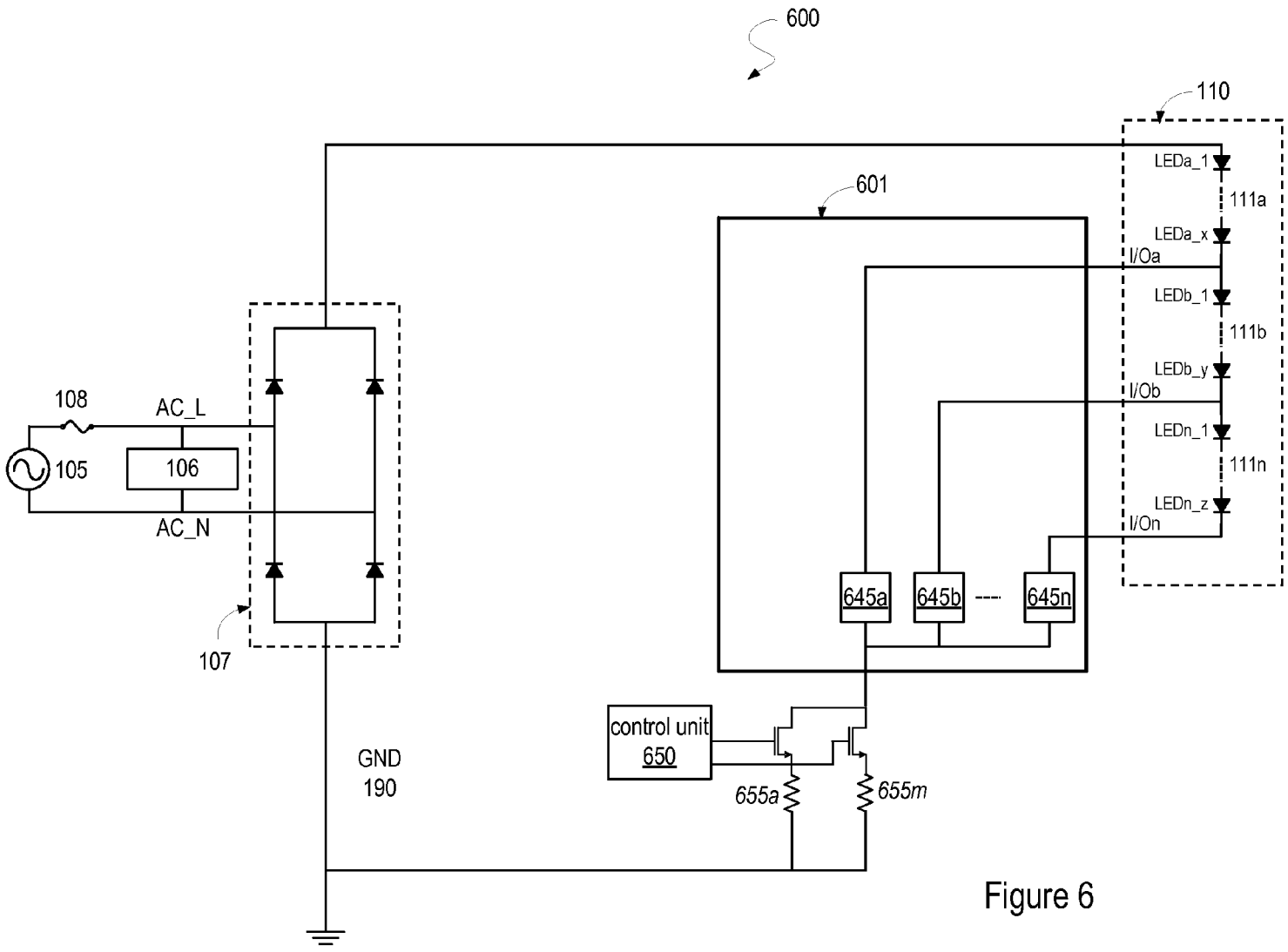
FIG. 6 illustrates a block diagram of an exemplary AC lighting system with multiple LED current paths controlled by a respective control unit, according to one embodiment.

FIG. 6 illustrates a block diagram of an exemplary AC lighting system with multiple LED current paths controlled by a respective control unit, according to one embodiment. The AC lighting system 600 controls to partially turn on/off of a plurality of LED current paths through a plurality of current sensing resistors 655*a*-655*m* that are connected in parallel. For example, the control unit 650 has two control outputs controlling each of the two LED current paths, and each of the two LED current paths has the same LED current sensing resistor 655. When one LED current path is turned off by the corresponding control output of the control unit 650, effective LED current is scaled by half compared to the case when two LED current paths are turned on. Similarly, multiple paths can be used to further provide a finer scaling of the LED current by selectively turning on and off the corresponding LED current paths. In one embodiment, the LED current sensing resistors 655 have different resistance values such that the scaling of the LED current can be controlled on a non-linear scale.

Figure 7:
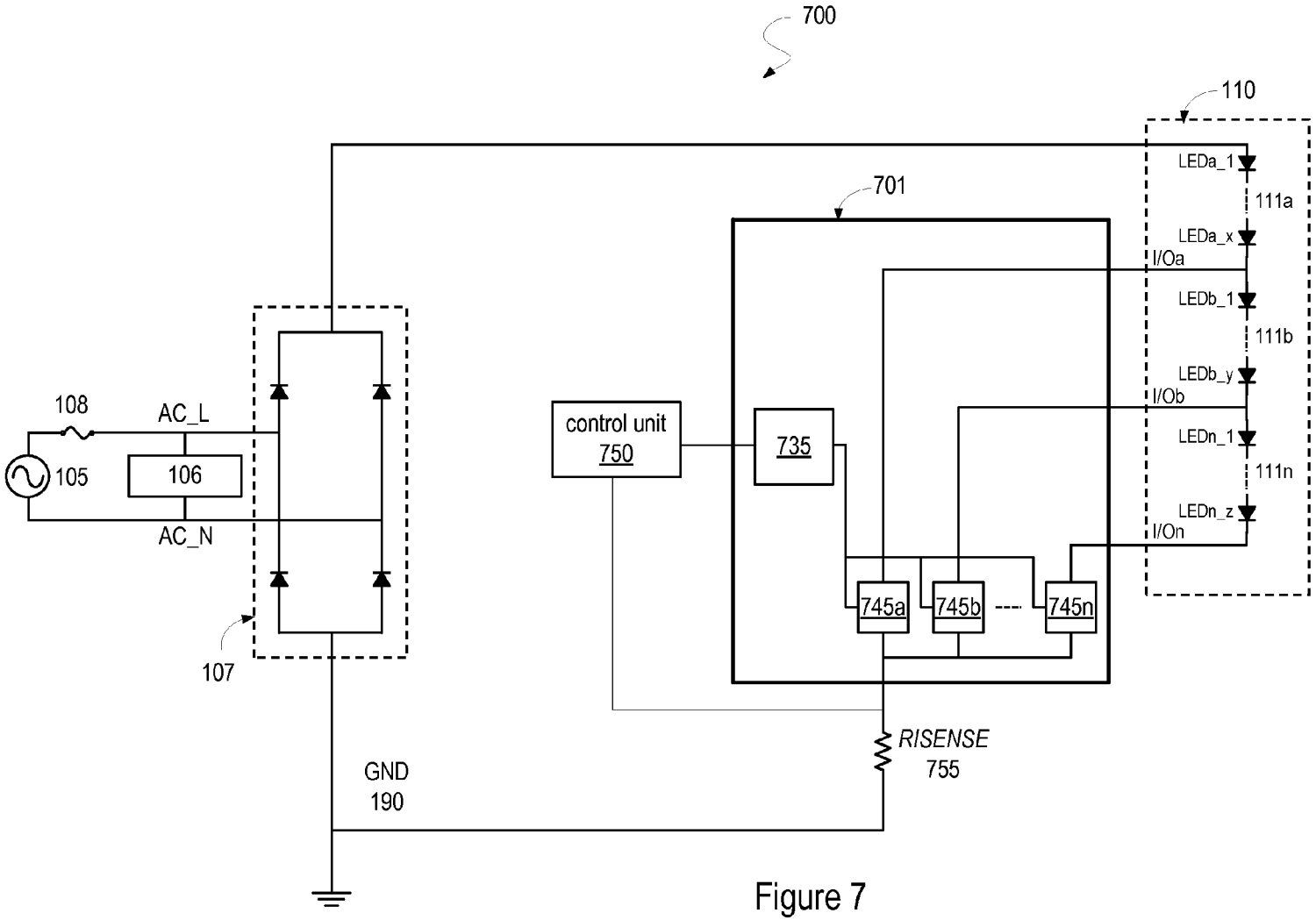
FIG. 7 illustrates a block diagram of an exemplary AC lighting system with a control unit that provides a control input to a LED driver based on an LED current sense, according to one embodiment.

FIG. 7 illustrates a block diagram of an exemplary AC lighting system with a control unit that provides a control input to a LED driver based on an LED current sense, according to one embodiment. The AC lighting system 700 has a control unit 750 that is coupled to a LED current level setting block 735 of the LED driver 701. The control unit 750 is also coupled to a LED current path of a LED sensing resistor 755. By sensing the LED current level at the LED current path of the LED sensing resistor 755, the control unit 750 provides a control input to the LED current level setting block 735 when the corresponding current sink 745 has a headroom. Each LED channel current sink increases up to a predefined current level for each current sink 745 and maintains its level until the following group's current sink reaches to its headroom. The control input of the control unit 750 to the LED current level setting block 735 may be a DAC input or a PWM input depending on the availability of an input type of the LED driver 701.

Figure 8:
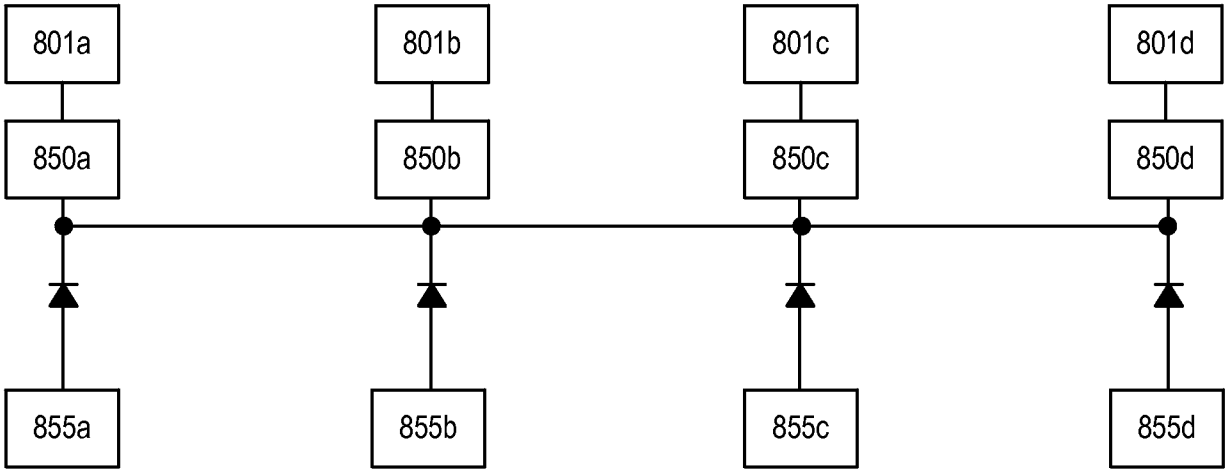
FIG. 8 illustrates a block diagram of an exemplary sensor circuit including a plurality of sensors, according to one embodiment.

FIG. 8 illustrates a block diagram of an exemplary sensor circuit including a plurality of sensors, according to one embodiment. The plurality of sensors 855*a*-855*d* are tied together to generated a single sensor signal. The raw output from each sensor 855 may be conditioned by a coupled gain/filter circuit, and the filtered signal from the gain/filter is provided across all control units 850*a*-850*d*. Each of the LED driver 801 is coupled to the corresponding control unit 850. Using the control input received at the control unit 850, the coupled LED driver 801 controls the LED current of the corresponding LED load (not shown) according to the methods described above. In this sensor circuit configuration, if any sensor's output is activated, the entire system responds to it. In one embodiment, each LED control module (i.e., the control unit 850 and the corresponding LED driver 801) has at least one extra input signal, and is configured to behave differently using the extra input signal available for each LED control module. In another embodiment, each LED control module is configured to respond differently to the same sensor input signal. For example, the sensor input signal is an analog input signal, and depending on the analog signal level, each LED control module can be configured to respond differently.

Figure 9:
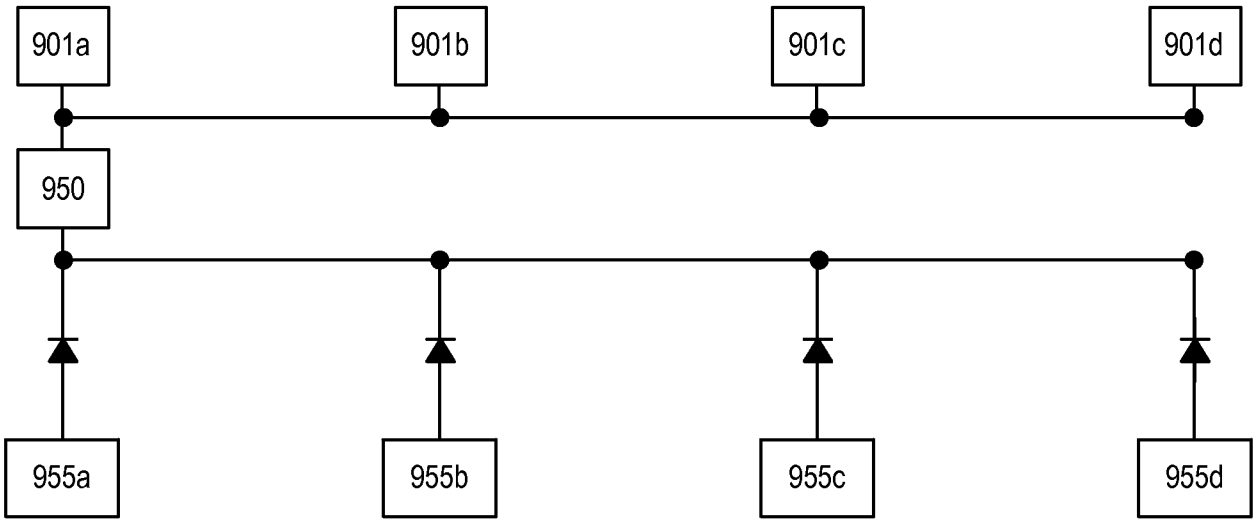
FIG. 9 illustrates a block diagram of an exemplary sensor circuit with a common control unit, according to one embodiment.

FIG. 9 illustrates a block diagram of an exemplary sensor circuit with a common control unit, according to one embodiment. Outputs from sensors 955 are tied together as a single sensor signal, and the sensor signal is fed to the control unit 950. The control unit 950 is connected to all LED drivers 901*a*-901*d*. By controlling a control input to a LED current level setting block within each of the LED driver 901, the LED current of the LED load (not shown) driven by the corresponding LED driver 901 is controlled as described herein.

Figure 10:
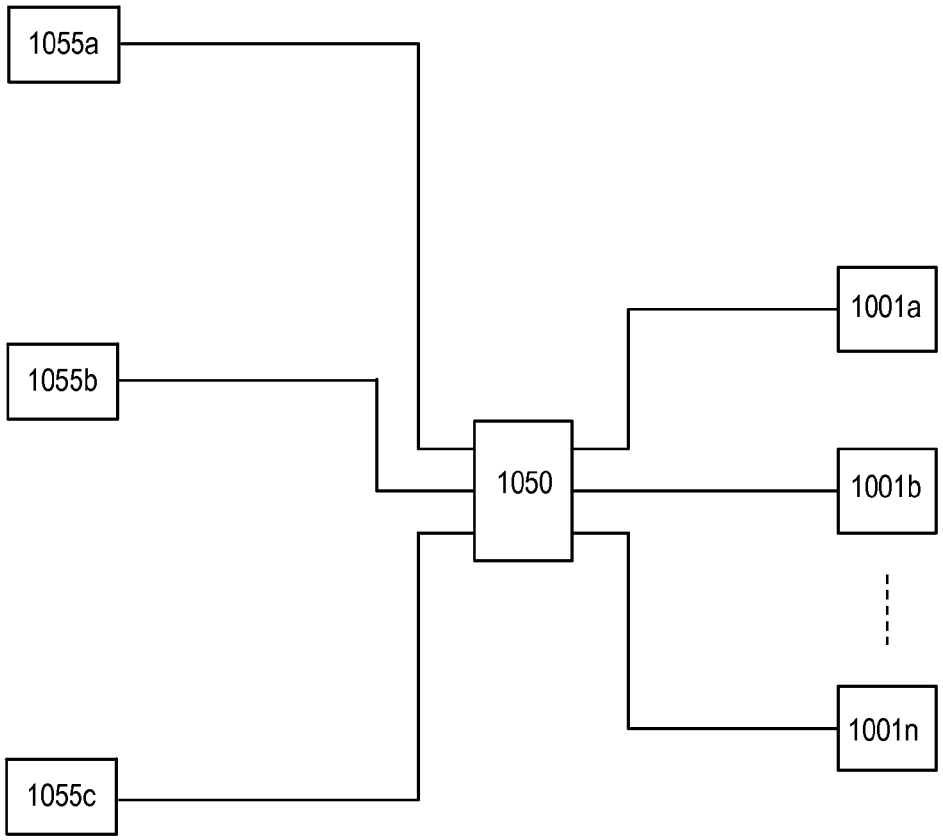
FIG. 10 illustrates a block diagram of another exemplary sensor circuit with a common control unit, according to one embodiment.

FIG. 10 illustrates a block diagram of another exemplary sensor circuit with a common control unit, according to one embodiment. The control unit 1050 receives signals from each sensor 1055*a*-1055*n*. Instead of combining sensor signals and controlling the LED drivers using a single sensor signal, the control unit 1050 receives each individual sensor signals from a plurality of sensors 1055*a*-1055*n* and controls the coupled LED drivers 1001*a*-1001*n* individually. For example, the control unit 1050 is configured to distinguish different sensor signals and drive one or more predetermined LED drivers in response to a specific sensor signal. The control unit 1050 receives multiple inputs and drives multiple LED drivers, and it is apparent to an ordinary skilled person in the art that a variety of control schemes may be implemented to program the control unit 1050 to respond differently based on the input and/or output conditions.

The input and output (I/O) signals of a control unit represent signals appearing on its input and output port. The I/O signals of a control unit can have different implementation such as an open-drain signal, an analog signal, a digital signal, or the like. An open-drain signal is used mostly to generate a logic (hi/low) signal. An analog signal (herein also referred to as DAC) is used to generate analog voltage signal, and is mostly an output signal of a control unit. A digital signal (herein also referred to as ADC) is used to translate an analog voltage signal to a digital signal, and is mostly an input signal of a control unit.

According to one embodiment, an input signal to a control unit is a sensor-based signal from a variety of sensor types such as an ambient light sensor, a motion sensor, a radio wave sensor, a color sensor, an ambient sound sensor, a temperature sensor, and a vibration sensor. It is apparent to an ordinary skilled person in the art that other types of input signals including a user-configurable input signal can be used for a sensor input without deviating from a scope of the present disclosure.

According to another embodiment, an input signal to a control unit is a system-based signal such as an AC main line level detection signal, a temperature detection signal, a dimming detection signal, a dimming level detection signal, and a dimming type detection signal.

According to one embodiment, an output signal from a control unit is used to control the LED current as described with references to the examples described above.

The above example embodiments have been described hereinabove to illustrate various embodiments of implementing an AC lighting system with a control unit for controlling power of an LED and the method thereof. Various modifications and departures from the disclosed example embodiments will occur to those having ordinary skill in the art. The subject matter that is intended to be within the scope of the invention is set forth in the following claims.

We claim:

1. A driver circuit for driving light emitting diodes (LEDs) comprising:

a first interface configured to receive an alternating current (AC) power from an AC power source;

a second interface configured to connect to a plurality LED groups;

a plurality of current sinks, each current sink of the plurality of current sinks controlling an LED current flowing through a corresponding LED group of the plurality of LED groups;

a current level setting block configured to generate a fixed reference voltage; and a third interface configured to receive an adjustable direct current (DC) control voltage input from a control unit, wherein the control unit is external to the driver circuit and connected to the current level setting block via the third interface, and wherein a voltage difference between the adjustable DC control voltage input from the control unit and the fixed reference voltage generated by the current level setting block is used to control an LED current that flows through the plurality of LED groups and adjust brightness of the plurality of LED groups.

2. The driver circuit of claim 1, wherein a setting resistor is connected between the third interface and the control unit, and wherein the control unit changes a control voltage output to control a current value that flows the setting resistor and the LED current flowing through the plurality of LED groups.

3. The driver circuit of claim 1, wherein the third interface comprises a pulse-width-modulation (PWM) pin and wherein the control unit controls an input to the PWM pin of the driver circuit to control the LED current.

4. The driver circuit of claim 1 further comprising a fourth interface for connecting an LED current sensing resistor.

5. The driver circuit of claim 4, wherein the LED current sensing resistor is a variable resistor, and the control circuit controls a resistor value of the variable resistor.

6. The driver circuit of claim 4, wherein the fourth interface is configured to connect a plurality of LED current sensing resistors, and wherein the control unit provides a control input to each of the plurality of LED current sensing resistors.

7. The driver circuit of claim 4, wherein the control unit provides the adjustable DC control voltage input to the driver circuit via the third interface based on a current value from the LED current sensing resistor.

8. The driver circuit of claim 1, wherein the control unit provides a dimming control for one or more of a voltage dimmer, a PWM dimmer, a triode for alternating current (TRIAC) dimmer.

9. The driver circuit of claim 1, wherein the control unit receives a sensor input from a sensor and provides the adjustable DC control voltage input via the fourth interface based on the sensor input.

10. The driver circuit of claim 9, wherein the sensor is selected from a group comprising a light sensor, a motion sensor, a touch sensor, a temperature sensor, and a humidity sensor.

11. An AC lighting system for driving LEDs comprising:

an AC power source;

a plurality of LED groups;

an LED driver connected between the AC power source and the plurality of LED groups, the LED driver being configured to control an LED current of the plurality of LED groups; and a control unit for providing an adjustable DC control voltage input to the LED driver, wherein the control unit is external to the LED driver and connected to a current level setting block of the LED driver, the current level setting block being configured to generate a fixed reference voltage, and wherein the LED driver controls the LED current of the plurality of LED groups based on a voltage difference between the adjustable DC control voltage input from the control unit and the fixed reference voltage generated by the current level setting block of the LED driver and adjusts brightness of the plurality of LED groups.

12. The AC lighting system of claim 11 further comprising a setting resistor, wherein the setting resistor is connected between the LED driver and the control unit, and wherein the control unit changes a control voltage output to control a current value that flows the setting resistor and the LED current flowing through the plurality of LED groups.

13. The AC lighting system of claim 11, wherein the control signal is a PWM signal.

14. The AC lighting system of claim 11 further comprising an LED current sensing resistor, wherein the control unit generates the adjustable DC control voltage input based on a current value that flows through the LED current sensing resistor.

15. A method for driving a plurality of LED groups comprising:

providing an LED driver that is configured to control an LED current flowing through a corresponding LED group of the plurality of LED groups;

generating a fixed reference voltage using a current level setting block of the LED driver, receiving an adjustable DC control voltage input from a control unit, wherein the control unit is external to the LED driver and connected to the current level setting block of the LED driver;

controlling the LED current based on a voltage difference between the adjustable DC control voltage input and the fixed reference voltage generated by the current level setting block of the LED driver; and adjusting brightness of the plurality of LED groups.

16. The method of claim 15 further comprising connecting a setting resistor between the LED driver and the control unit, and wherein the control unit changes a control voltage output to control a current value that flows the setting resistor and the LED current flowing through the plurality of LED groups.

17. The method of claim 15, wherein the adjustable DC control voltage input is a PWM signal.

18. The method of claim 15 further comprising:

connecting an LED current sensing resistor; and generating the adjustable DC control voltage input based on a current value that flows through the LED current sensing resistor.

19. The method of claim 15, wherein the control unit provides a dimming control for one or more of a voltage dimmer, a PWM dimmer, a triode for alternating current (TRIAC) dimmer.

20. The method of claim 15 further comprising:

receiving a sensor input from a sensor; and providing the adjustable DC control voltage input based on the sensor input, wherein the sensor is selected from a group comprising a light sensor, a motion sensor, a touch sensor, a temperature sensor, and a humidity sensor.

* * * * *